US011192373B2

(12) United States Patent
Saito

(10) Patent No.: US 11,192,373 B2
(45) Date of Patent: Dec. 7, 2021

(54) PRINTING APPARATUS AND CONTROL METHOD THEREOF

(71) Applicant: CANON KABUSHIKI KAISHA, Tokyo (JP)

(72) Inventor: Nao Saito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/527,242

(22) Filed: Jul. 31, 2019

(65) Prior Publication Data

US 2020/0047502 A1 Feb. 13, 2020

(30) Foreign Application Priority Data

Aug. 7, 2018 (JP) ..... JP2018-148712

(51) Int. Cl.
*B41J 2/16* (2006.01)
*B41J 2/165* (2006.01)

(52) U.S. Cl.
CPC ..... *B41J 2/16505* (2013.01); *B41J 2/1652* (2013.01); *B41J 2/16535* (2013.01)

(58) Field of Classification Search
None
See application file for complete search history.

(56) References Cited

U.S. PATENT DOCUMENTS 7,918,532 B2 4/2011 Shimazaki ..... 347/29
2005/0185035 A1* 8/2005 Takei ..... B41J 2/17546 347/86
2007/0171249 A1* 7/2007 Usuda ..... B41J 2/16532 347/19
2007/0273733 A1* 11/2007 Kotaki ..... B41J 2/17513 347/85
2008/0143780 A1 6/2008 Sakamoto et al.
2009/0033707 A1 2/2009 Shimazaki
2009/0239044 A1* 9/2009 Habashi ..... C09D 11/322 428/195.1
2011/0199422 A1* 8/2011 Shimazaki ..... B41J 2/16508 347/29
2011/0242206 A1 10/2011 Komatsu et al. ..... 347/29
2017/0291421 A1* 10/2017 Okuda ..... B41J 2/16552

FOREIGN PATENT DOCUMENTS

CN 206277805 U 6/2017
JP 2003-145783 5/2003
JP 2004209897 A 7/2004
JP 2009-034912 2/2009
JP 4872849 B 2/2012
JP 4958533 B 6/2012
JP 2017-196794 11/2017

OTHER PUBLICATIONS

Office Action dated Feb. 3, 2021 in counterpart Chinese Application No. 201910724744.0, together with English translation thereof.

* cited by examiner

*Primary Examiner* — Erica S Lin
(74) *Attorney, Agent, or Firm* — Venable LLP

(57) ABSTRACT

According to the present invention, a printing apparatus is provided, the printing apparatus comprises a printhead including an ink discharge surface on which plurality of orifices for discharging ink are arranged and configured to print an image, a cap configured to cap the ink discharge surface, and a supply unit configured to selectively supply one of a plurality of types of liquids into the cap.

17 Claims, 12 Drawing Sheets

PRINTING APPARATUS AND CONTROL METHOD THEREOF

BACKGROUND OF THE INVENTION

Field of the Invention

The present invention relates to a printing apparatus and a method thereof, that forms an ink image using a liquid discharge device and, more particularly, to a maintenance mechanism and a control method of the discharge device.

Description of the Related Art

In an image printing apparatus that forms an ink image by a liquid discharge device (to be referred to as a head hereinafter), a device including a cap that has a shape paired with the discharge surface of the head and covers the entire discharge surface to maintain the discharge performance of the head is known (Japanese Patent No. 4958533). The cap is used to maintain the liquid discharge performance of the head. Using the cap, for example, ink is received when periodically performing discharge of ink (to be referred to as preliminary discharge hereinafter), a liquid (to be referred to as a washing liquid hereinafter) for washing dirt around orifices is stored, or the head is covered to prevent the orifices from drying to cause ink adhesion. To reliably prevent drying of the orifices by the cap, following arrangements and control methods have been proposed. In one arrangement, ink discharged from the head or a washing liquid supplied from another path into the cap is stored in the cap. The cap in which the washing liquid is stored is brought into contact with the discharge surface of the head (to be referred to as capping hereinafter), thereby maintaining the humidity and preventing the orifices from drying. Alternatively, an arrangement has been proposed in which a cap dedicated for moisturizing is provided independently of the cap that receives preliminary discharge of the head, and the cap itself is switched in accordance with the application purpose.

However, in these related arts, if ink containing a component (pigment or the like) that readily adheres is used as a liquid to be stored in a cap, the humidity in the cap does not rise, and moisturizing is insufficient.

Additionally, Japanese Patent Laid-Open No. 2004-209897 proposes using a washing liquid as a liquid to be stored in a cap. However, if a mechanism that washes an ink discharge surface does not have a sealed structure like a cap, the washing liquid often contains a component (glycerin or the like) aiming at preventing evaporation of the liquid itself. In this case, even if the washing liquid is stored in the cap, the humidity in the cap does not rise, and moisturizing is insufficient. There is also a proposal of providing a cap dedicated for moisturizing independently of a cap that receives ink, like Japanese Patent No. 4872849. However, if a plurality of caps storing liquids according to purposes are provided, the device becomes bulky, including a switching mechanism for the caps.

SUMMARY OF THE INVENTION

The present invention provides a printing apparatus that switches the type of a liquid to be supplied to the cap of a printhead as needed for one cap mechanism, thereby maintaining the discharge performance of the head, and a control method thereof.

According to the first aspect of the present invention, there is provided a printing apparatus comprising: a printhead including an ink discharge surface on which plurality of orifices for discharging ink are arranged and configured to print an image; a cap configured to cap the ink discharge surface; and a supply unit configured to selectively supply one of a plurality of types of liquids into the cap.

According to the second aspect of the present invention, there is provided a control method of a printing apparatus including: a printhead including an ink discharge surface on which plurality of orifices for discharging ink are arranged and configured to print an image; and a cap configured to cap the ink discharge surface, the method comprising: selectively supplying one of a plurality of types of liquids into the cap.

According to the present invention, it is possible to obtain an effect of switching the type of a liquid to be supplied to the cap of the printhead as needed for one cap mechanism, thereby maintaining the discharge performance of the head.

Further features of the present invention will become apparent from the following description of exemplary embodiments with reference to the attached drawings.

DESCRIPTION OF THE EMBODIMENTS

Embodiments of the present invention will be described with reference to the accompanying drawings. In each view, arrows X and Y indicate horizontal directions perpendicular to each other. An arrow Z indicates a vertical direction.

<Printing System>

Figure 1:
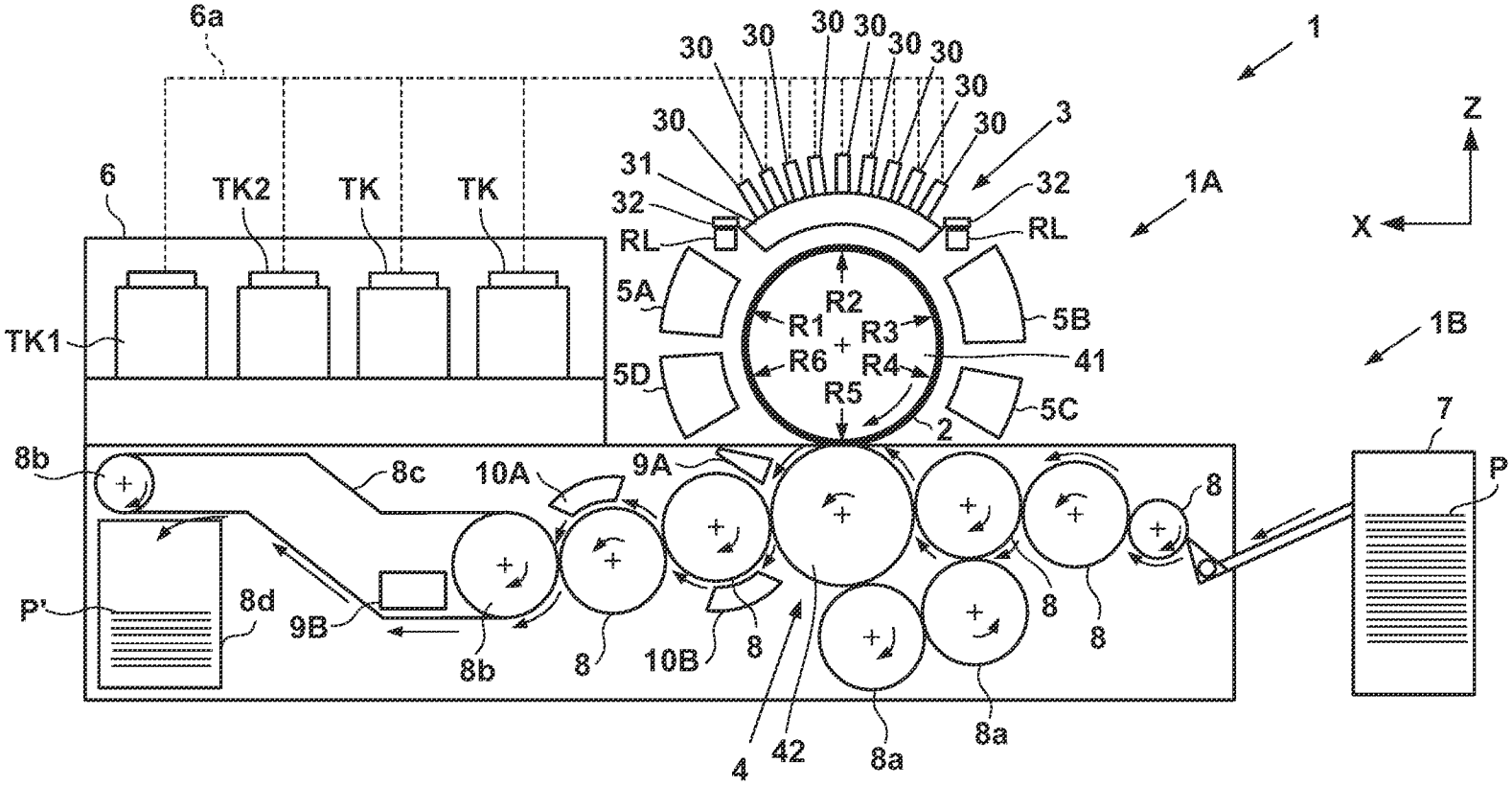
FIG. 1 is a schematic view showing a printing system.

FIG. 1 is a front view schematically showing a printing system 1 according to an embodiment of the present invention. The printing system 1 is a sheet inkjet printer that forms (manufactures) a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
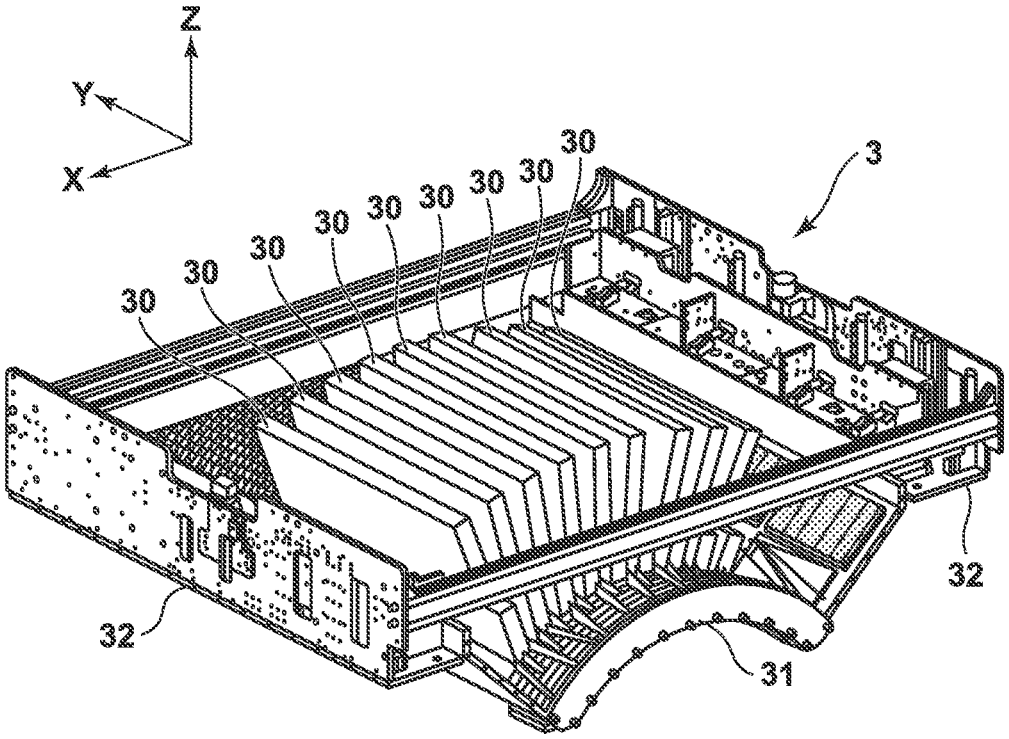
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
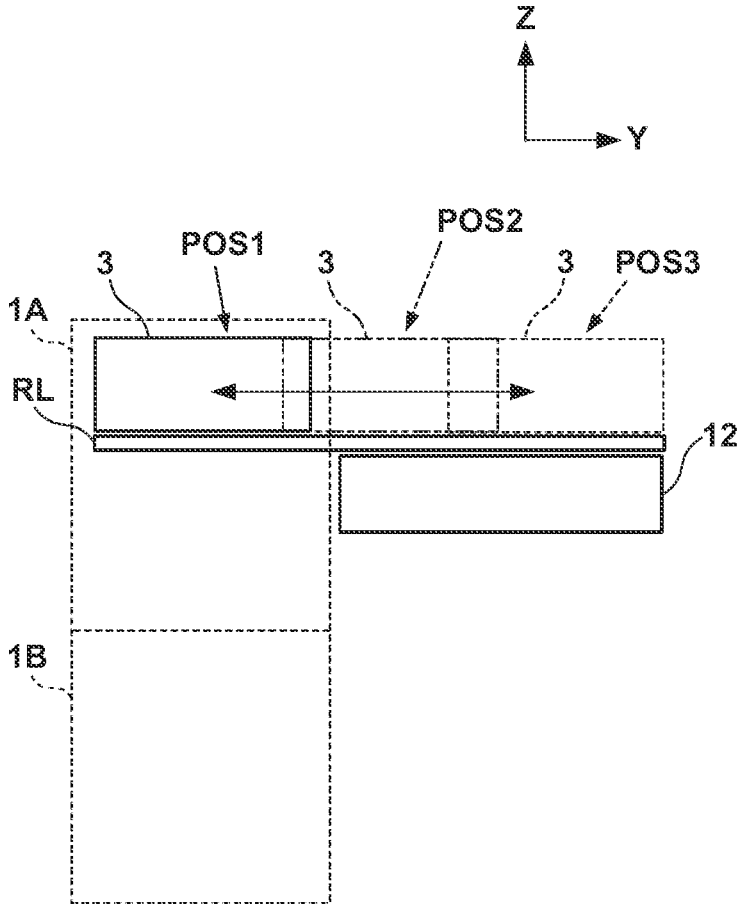
FIG. 3 is an explanatory view showing a displacement mode of the print unit in FIG. 2.
Figure 8:
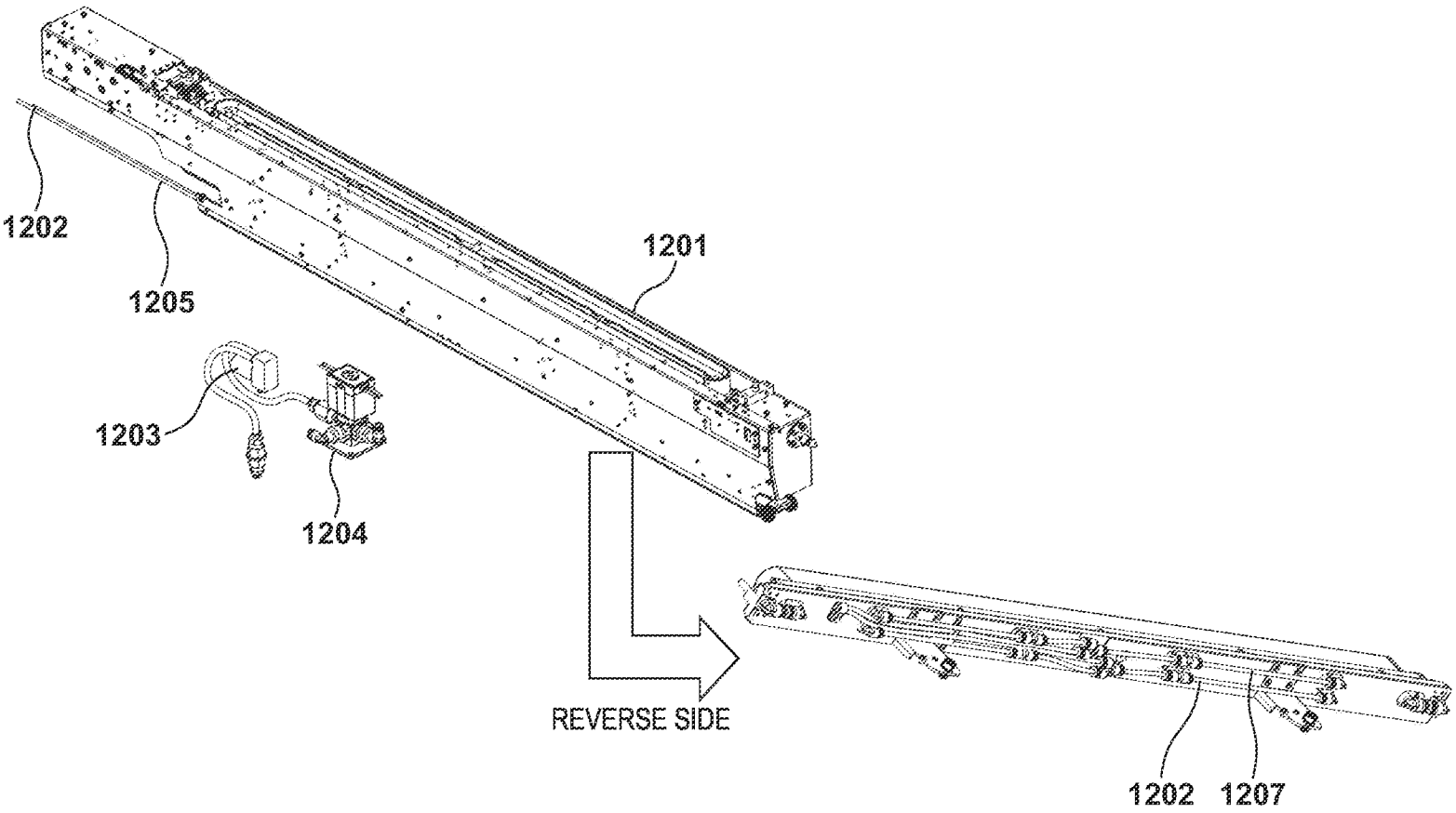
FIG. 8 is a perspective view of a recovery unit in FIG. 3.
Figure 9:
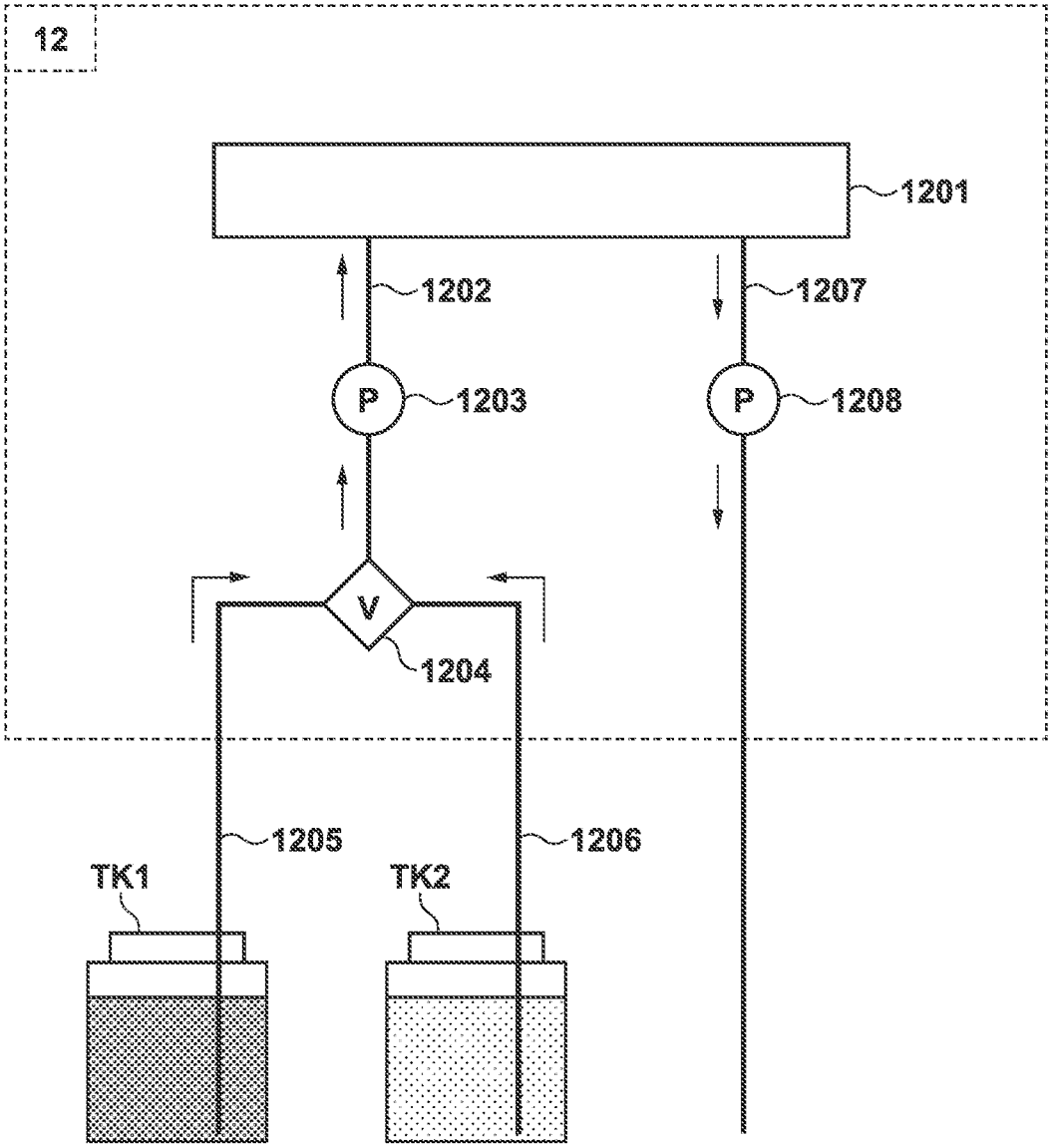
FIG. 9 is a schematic view of the recovery unit in FIG. 3.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. FIG. 8 is a perspective view of the recovery unit, and FIG. 9 is a schematic view of the recovery unit. In the recovery unit 12, a cap mechanism (also called a cap) 1201 that is paired with each of the printheads 30 and caps the ink discharge surface is provided for each ink color. The cap mechanism 1201 is provided to face the printhead 30 when the printhead 30 is located at a retract position (a position for recovery). The recovery unit 12 also includes a supply path 1202 that supplies a liquid for maintaining the performance of the ink discharge surface to the cap 1201, and a supply pump 1203 serving as a driving unit. A three-way valve (also called a supplied liquid switching valve) 1204 capable of switching two types of liquids to be supplied to the cap 1201 is provided in the middle of the supply path 1202. The two remaining paths of the three-way valve include a first flow path 1205 connected to a washing liquid tank TK1 storing a washing liquid for the head discharge surface, and a second flow path 1206 connected to a moisturizing liquid tank TK2 storing a moisturizing liquid for the head discharge surface. The cap 1201 also includes a discharge flow path 1207 and a discharge pump 1208 (not shown in FIG. 8) that sends a discharge liquid, which are used to discharge the liquid in the cap. As other recovery mechanisms, for example, a wiper mechanism that wipes the ink discharge surface and a suction mechanism that sucks ink in the printhead 30 by negative pressure from the ink discharge surface can be used. Note that the flow paths that are not illustrated in FIG. 8 are connected as in FIG. 9. The cap 1201 is formed to, for example, enclose nozzles arranged in the corresponding printhead 30, and capping can be done by bringing the cap 1201 into tight contact with the printhead 30 (cap close). The cap 1201 in the cap close state may be configured to hold a moisturizing liquid or the like. In this embodiment, to measure the time of capping (cap close time) by the cap 1201, a timer (measuring unit) is activated at the same time as the start of capping.

As shown in FIG. 3, the guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown). In addition, a discharge surface cleaning mechanism including a roller to which a washing liquid (not shown) is applied is provided such that the ink discharge surface can be cleaned when the print unit 3 moves to the recovery position. Note that as the washing liquid according to this embodiment, a washing liquid containing glycerin as a solvent is used to prevent transpiration of the liquid. In addition, pure water is used as the moisturizing liquid.

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42. The transfer drum 41 and the pressurizing drum 42 can share a driving source such as a motor that drives them, and a driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs the liquid component from the ink image on the transfer member 2 before transfer. When the liquid component of the ink image is decreased, bleeding or the like of an image printed on the print medium P can be suppressed. From another viewpoint, the decrease of the liquid component can also be expressed as condensing the ink of the ink image on the transfer member 2. Condensing ink means that the liquid component contained in the ink image decreases, and the content ratio of a solid content such as a coloring material or a resin contained in the ink to the liquid component increases.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. The supply unit 6 also includes the reservoirs TK1 and TK2 for maintenance, which reserve maintenance liquids such as a washing liquid and a moisturizing liquid. Each reservoir TK may be made of a main tank and a sub tank. Each reservoir TK and a corresponding one of the printheads 30 communicate with each other by a flow path 6*a*, and ink is supplied from the reservoir TK to the printhead 30. The flow path 6*a* may circulate ink between the reservoirs TK and the printheads 30. The supply unit 6 may include, for example, a pump that circulates ink. A deaerating mechanism which deaerates bubbles in ink may be provided in the middle of the flow path 6*a* or in each reservoir TK. A valve that adjusts the fluid pressure of ink and an atmospheric pressure may be provided in the middle of the flow path 6*a* or in each reservoir TK. The heights of each reservoir TK and each printhead 30 in the Z direction may be designed such that the liquid surface of ink in the reservoir TK is positioned lower than the ink discharge surface of the printhead 30. The reservoirs TK1 and TK2 for maintenance have the arrangement as described with reference to FIG. 3, and stores a washing liquid and a moisturizing liquid, respectively, as maintenance liquids in this example. By the function of the three-way valve 1204 (see FIG. 3), one of the liquids can be selected and supplied to the cap 1201. Note that the reservoirs TK1 and TK2 for maintenance may be arranged in a place other than the supply unit 6, and can be arranged inside or outside of the printing system 1 as long as the place can easily be accessed access by the user.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, glossy, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
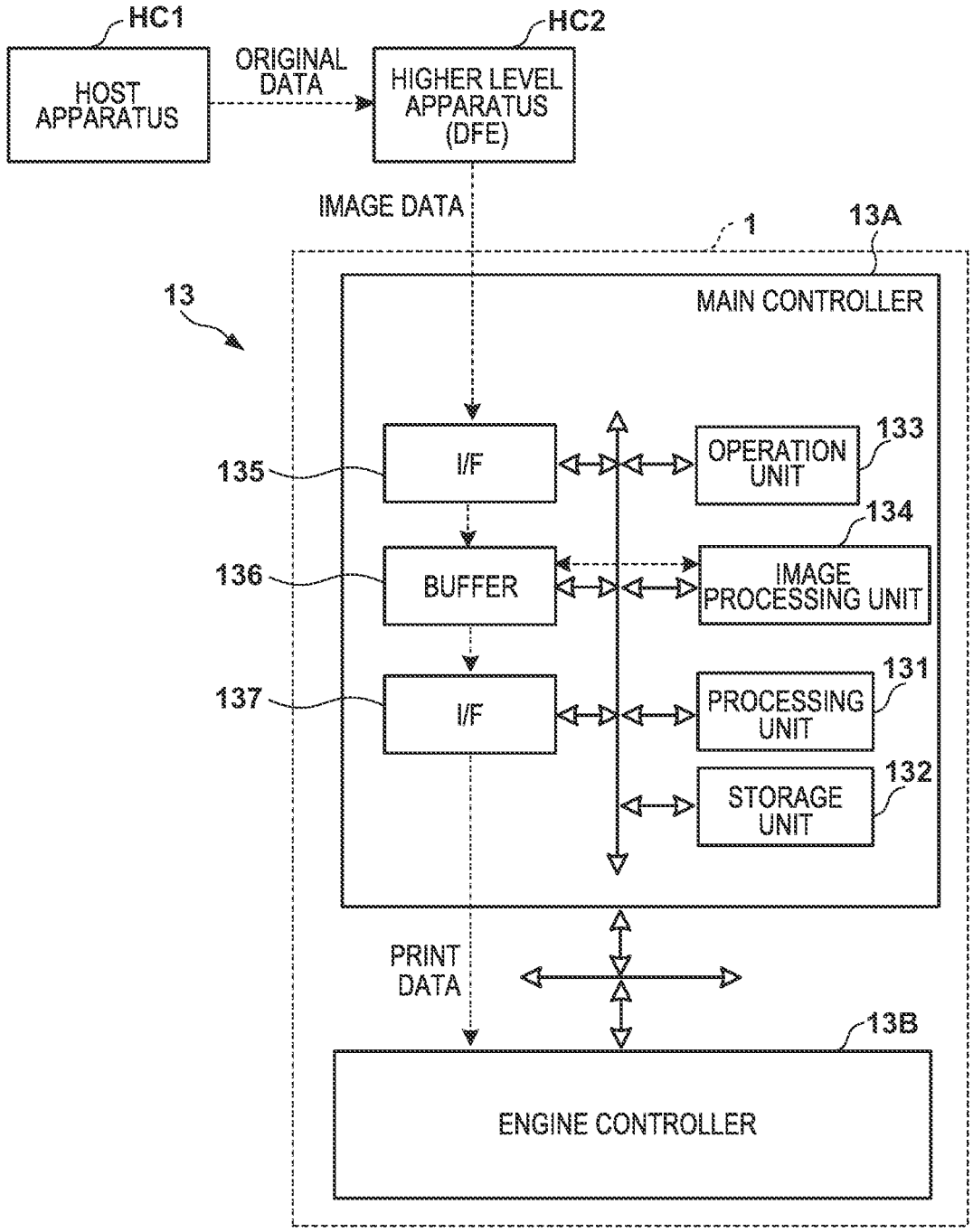
FIG. 4 is a block diagram showing a control system of the printing system in FIG. 1.
Figure 5:
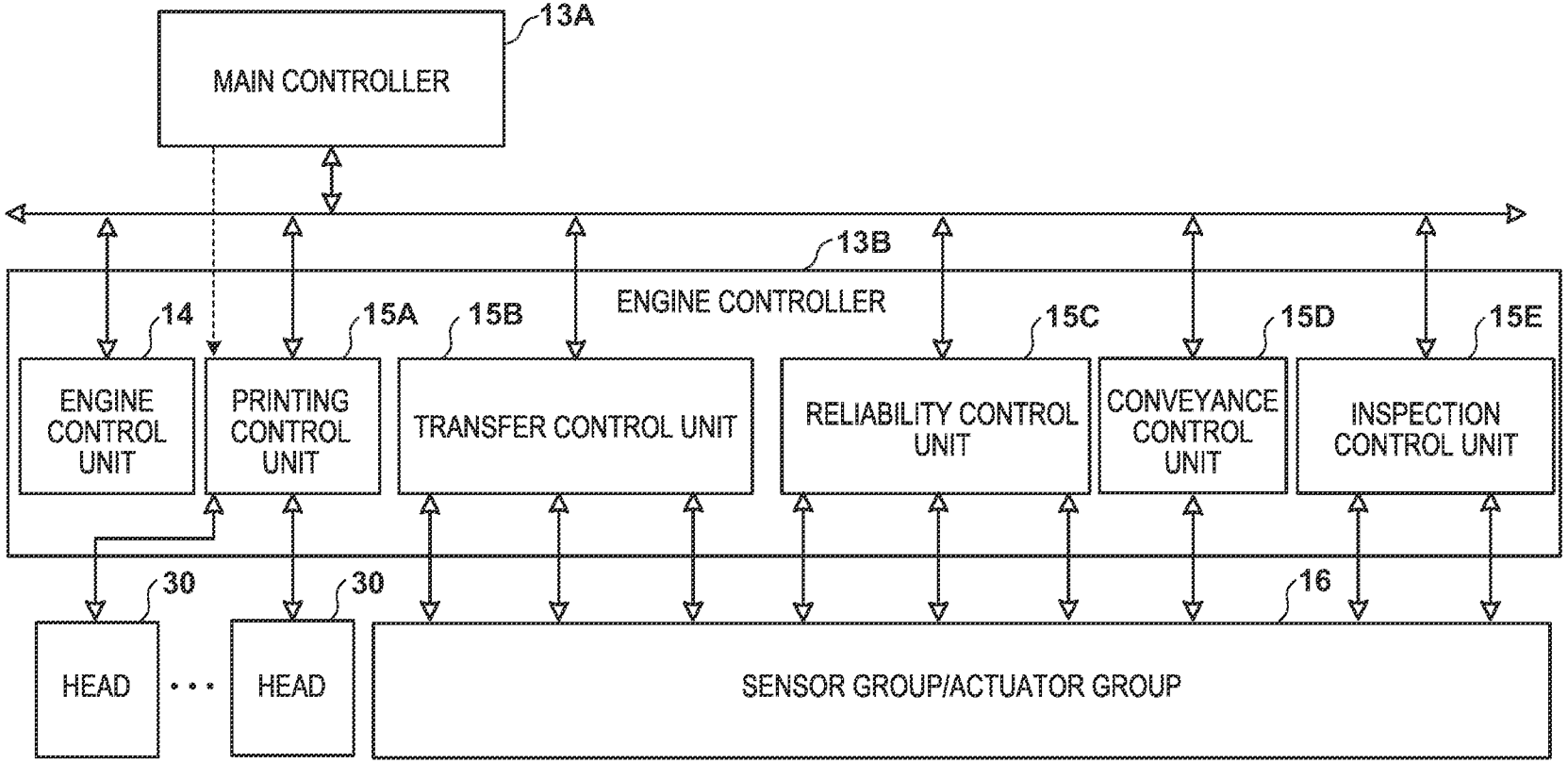
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
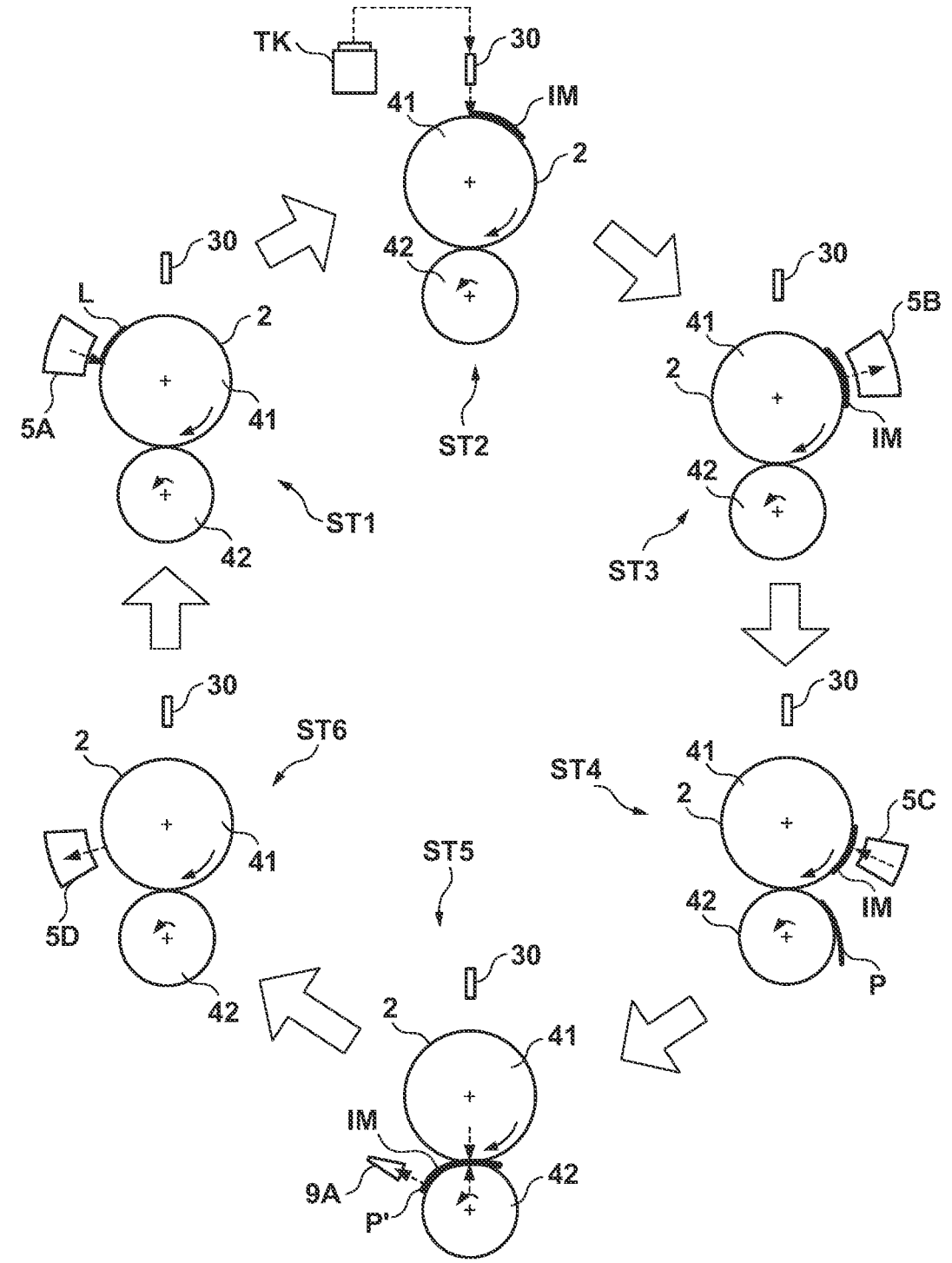
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, a liquid component is absorbed from the ink image IM by the absorption unit 5B, as shown in a state ST3. When the ink image IM reaches the heating unit 5C, the ink image IM is heated by the heating unit 5C, a resin in the ink image IM melts, and a film of the ink image IM is formed, as shown in a state ST4. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Figure 7:
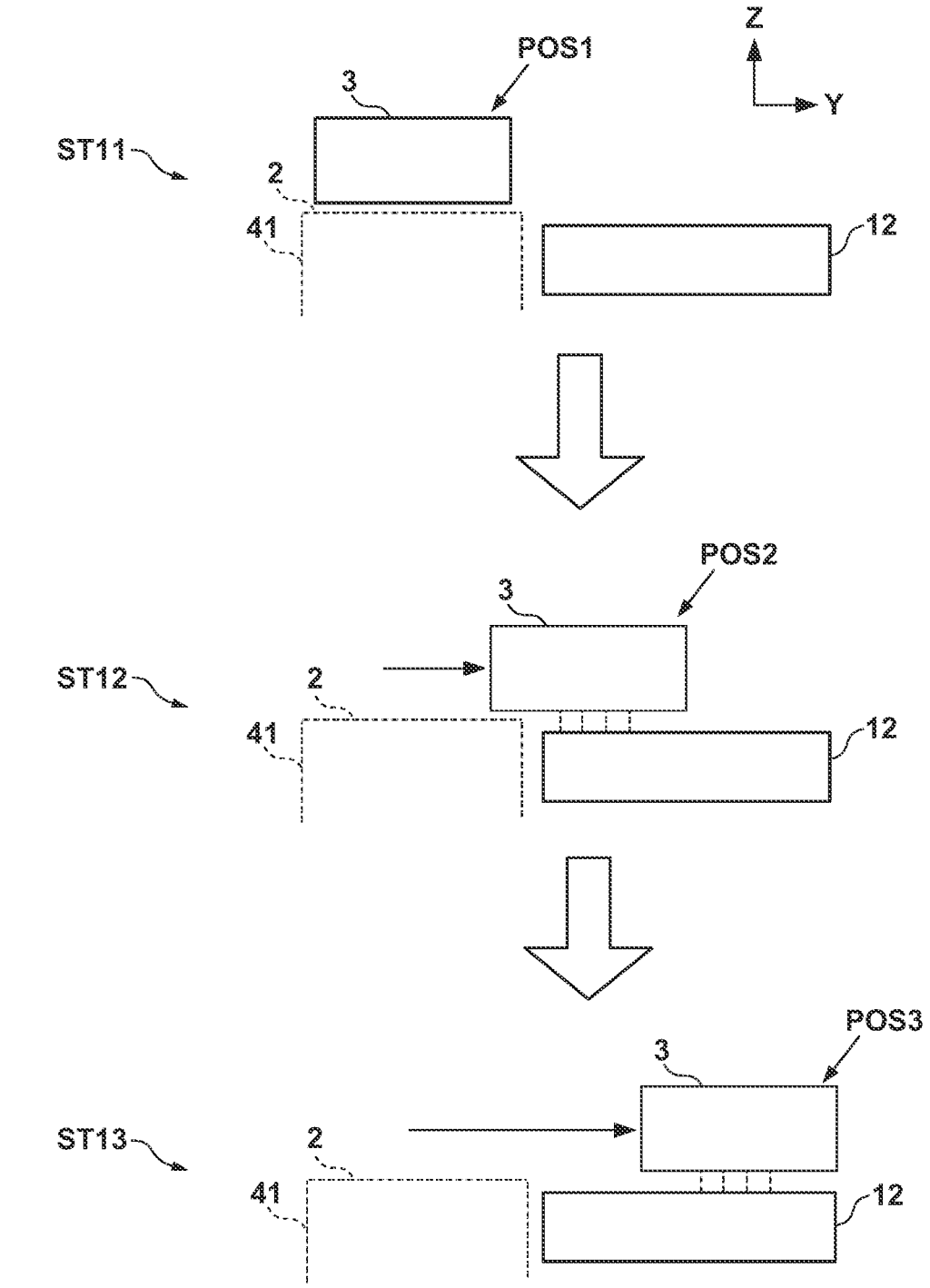
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

Recovery Processing

Figure 10:
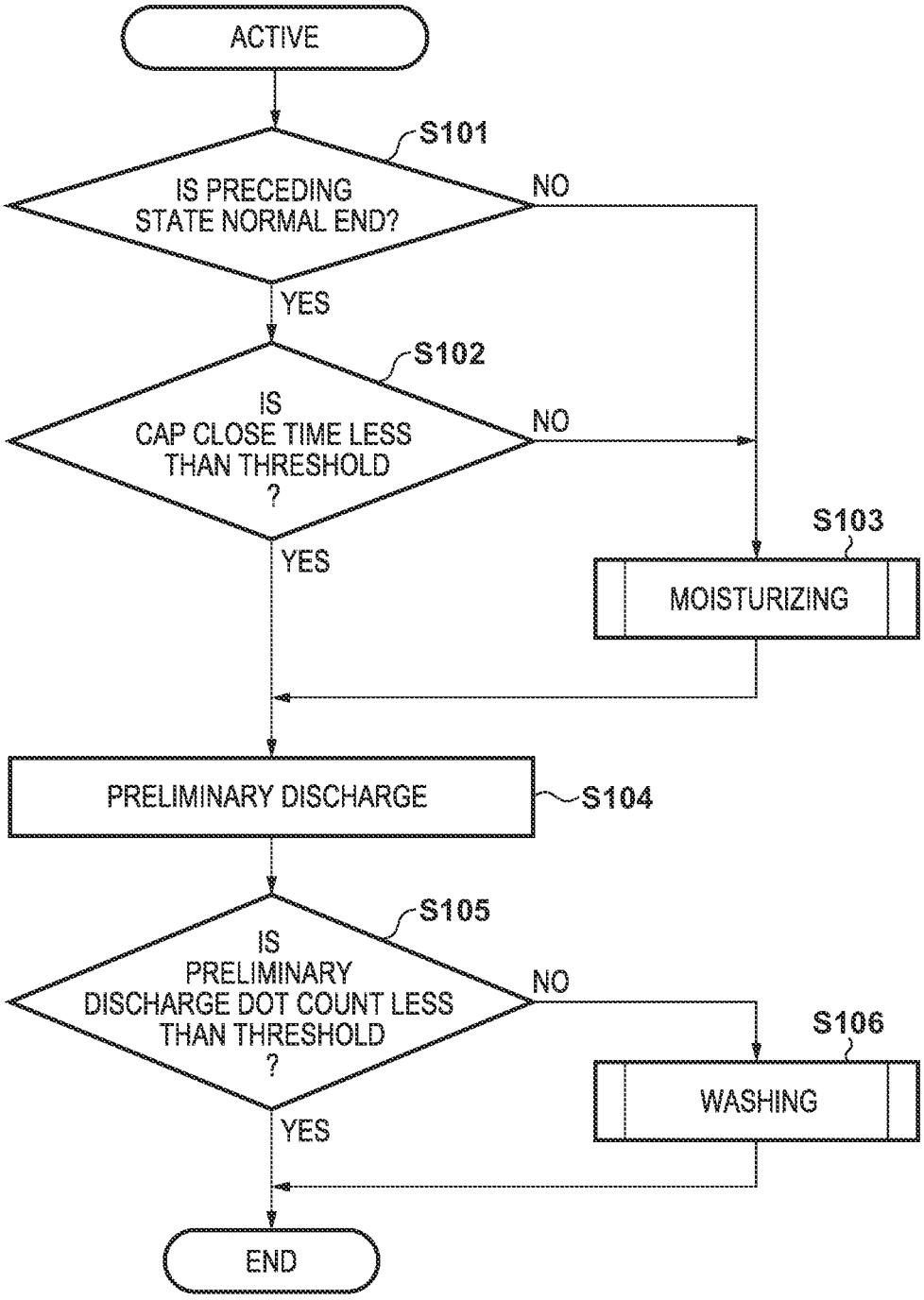
FIG. 10 is a flowchart of an example of the operation of a switching control unit in FIG. 9.

Control of the recovery unit 12 by the reliability control unit 15C will be described with reference to FIG. 10. Processing shown in FIG. 10 is executed for each cap 1201 at the time of, for example, activation (power on or the like) of the printing apparatus 1A. At the time of activation of the printing apparatus 1A, in step S101, it is determined whether the preceding apparatus end state is a normal end. The normal end here indicates that the apparatus was powered off in a state in which the printheads 30 are capped without any error. This determination can be done by, for example, storing, in a predetermined nonvolatile storage area, information representing the normal end if it is normal at the time of power-off of the apparatus and referring to the area in step S101 at the time of activation. Hence, when the processing step advances from step S101 to step S102, the information representing the normal end is erased. If the determination result in step S101 represents the normal end, it is determined, in step S102, whether the cap close time is less than a threshold. The cap close time can be acquired by referring to the timer that is activated when closing the cap 1201, as described with reference to FIG. 3.

If the determination result in step S101 does not represent the normal end, or if the determination result in step S102 represents that the cap close time is equal to or more than the threshold, moisturizing processing in step S103 to be described later is executed. This is because there is a possibility that the printhead 30 is dry. That is, if it is determined that there is a possibility that the printhead 30 is dry, a moisturizing liquid is supplied to the cap 1201 by moisturizing processing. After that, irrespective of the presence/absence of execution of step S103, preliminary discharge is executed in step S104. In step S105, it is determined whether the total preliminary discharge dot count into the cap, which is calculated by a counter, exceeds a predetermined threshold. As a result, if the total preliminary discharge dot count exceeds the predetermined threshold, washing processing in step S106 to be described later is executed. This is because there is a possibility that the residual of ink discharged by preliminary discharge may be deposited on an absorber or the like in the cap 1201. That is, if it is determined that there is a possibility of a deposit in the cap 1201, a washing liquid is supplied to the cap 1201 by washing processing.

Figure 11:
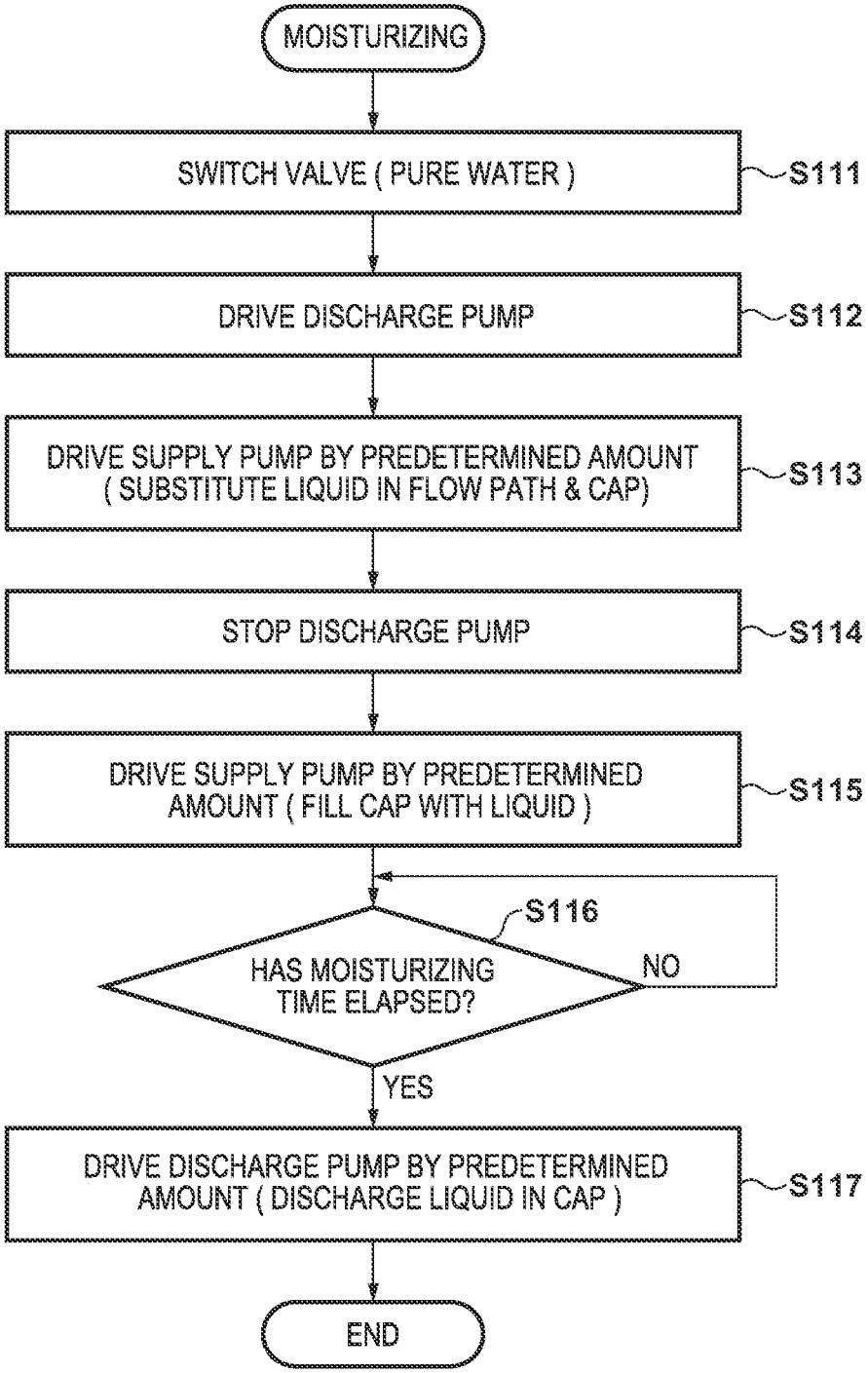
FIG. 11 is a flowchart of an example of the operation of "moisturizing" in FIG. 10.

The moisturizing processing S103 in FIG. 10 will be described with reference to FIG. 11. In step S111, the supplied liquid switching valve 1204 is switched to a direction (the side of the second flow path 1206 connected to the moisturizing liquid tank TK2) in which the moisturizing liquid can be supplied. In step S112, the discharge pump 1208 is driven. In that state, the supply pump 1203 is driven by a predetermined amount in step S113. The predetermined amount is an amount to rinse the liquid remaining in the cap 1201 and the supply path 1202 to the cap by the moisturizing liquid. Then, in step S114, driving of the discharge pump 1208 is stopped. In step S115, the supply pump 1203 is driven by a predetermined amount to fill the cap 1201 with the moisturizing liquid. In step S116, the processing waits for the elapse of a predetermined moisturizing time. After that, in step S117, the discharge pump 1208 is driven by a predetermined amount to discharge the moisturizing liquid in the cap.

Figure 12:
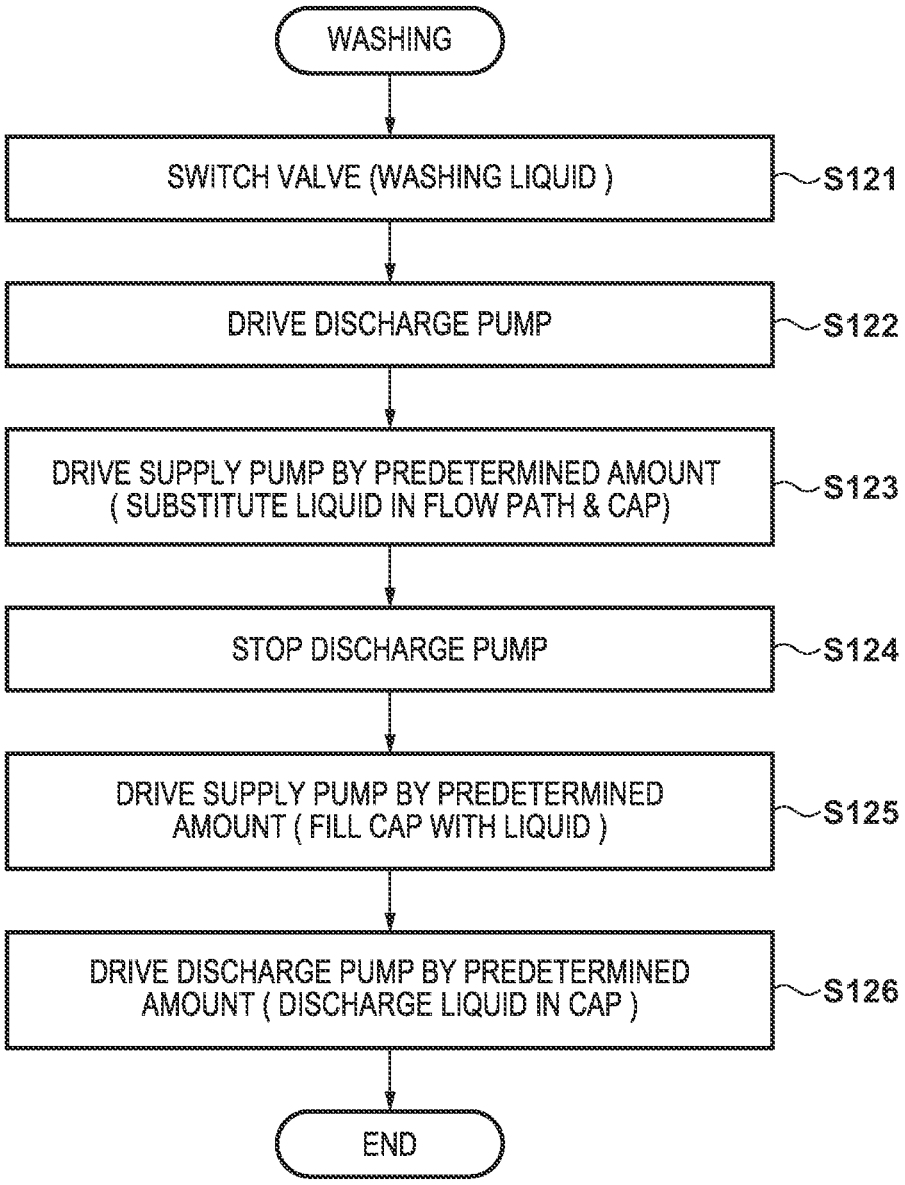
FIG. 12 is a flowchart of an example of the operation of "washing" in FIG. 10.

The washing processing S106 in FIG. 10 will be described with reference to FIG. 12. In step S121, the supplied liquid switching valve 1204 is switched to a direction (the side of the first flow path 1205 connected to the washing liquid tank TK1) in which the washing liquid can be supplied. In step S122, the driving of the discharge pump 1208 is started. In that state, the supply pump 1203 is driven by a predetermined amount in step S123. The predetermined amount is an amount to rinse the liquid remaining in the cap 1201 and the supply path 1202 to the cap by the washing liquid. Then, in step S124, driving of the discharge pump 1208 is stopped. In step S125, the supply pump 1203 is driven by a predetermined amount to fill the cap 1201 with the washing liquid. In step S126, the discharge pump 1208 from the cap is driven by a predetermined amount to discharge the washing liquid in the cap.

With the above-described control operation, it is possible to switch the type of a liquid to fill the cap as needed and selectively supply one of a plurality of types of maintenance liquids for one cap mechanism. That is, in the above-described example, for example, moisturizing and washing can be switched. This can maintain the discharge performance of the printhead.

In this embodiment, the liquid in the washing liquid tank TK1 is the washing liquid, and the liquid in the moisturizing liquid tank TK2 is the moisturizing liquid. This arrangement is merely an example, and a liquid of another type may be put into the cap. In addition, the driving time of each pump, the threshold, and the like may be predetermined fixed values or variable values given from an input unit or the like. In the above example, the maintenance liquid is switched by a valve. Instead, the type of the maintenance liquid to be supplied may be switched by supplying the liquids from the washing liquid tank TK1 and the moisturizing liquid tank TK2 to the printhead via independent supply paths and selecting one of the pumps of the supply paths to be driven.

In addition, the processing shown in FIG. 10 is executed at the time of activation (power on or the like) of the printing apparatus 1A. However, when a printing operation for a predetermined time or a printing operation of a predetermined amount is performed, and it is determined that the recovery processing is necessary, the processing may be started in a state in which the printhead 30 is moved to the recovery position POS3. In this case, step S101 may not be performed, and the processing may be started from step S102. Furthermore, the procedures shown in FIGS. 10 to 12 are executed by the reliability control unit 15C of the engine controller 13B. The procedures may be executed by another control unit, for example, the processing unit 131 of the main controller 13A. In this case, the sensor group/actuator group 16 may be remote-controlled from the main controller 13A.

Other Embodiments

The print unit 3 includes the plurality of printheads 30 in the above embodiment, but may include one printhead 30. The printhead 30 need not be a full-line head and may be of a serial type that discharges ink from the printhead 30 to form an ink image while moving, in the Y direction, the carriage on which the printhead 30 is detachably mounted.

The conveyance mechanism of the print medium P may use another method such as a method of conveying the print medium P sandwiched by a roller pair. In the method of conveying the print medium P by a roller pair, a roll sheet may be used as the print medium P, and the roll sheet may be cut after transfer to manufacture the printed product P'.

In the above embodiment, the transfer member 2 is provided on the outer peripheral surface of the transfer drum 41. However, another method such as a method of forming the transfer member 2 into an endless swath shape and causing the transfer member 2 to cyclically run may be used.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-148712, filed Aug. 7, 2018 which is hereby incorporated by reference herein in its entirety.

What is claimed is:

1. A printing apparatus comprising:

a printhead including a discharge surface, a plurality of orifices for discharging liquid being arranged on the discharge surface;

a cap configured to cap the discharge surface;

a first reservoir configured to hold water;

a second reservoir configured to hold a washing liquid used to wash the printhead;

a switching unit configured to switch a reservoir connected to the cap such that one of the first reservoir and the second reservoir is connected to the cap; and a supply unit configured to selectively supply one of the water and the washing liquid according to the connected reservoir into the cap without passing through the printhead.

2. The printing apparatus according to claim 1, further comprising a control unit configured to control the switching unit in accordance with recovery process for the printhead and supply one of the water and the washing liquid to the cap.

3. The printing apparatus according to claim 2, further comprising:

a measuring unit configured to measure a capping time in which the cap caps the discharge surface; and a counter configured to count discharges from the printhead into the cap, wherein the control unit is further configured to execute a moisturizing process that includes connecting the first reservoir and the cap in a case where the capping time measured by the measuring unit is larger than a first threshold, and execute a washing process that includes connecting the second reservoir and the cap in a case where the number of discharges counted by the counter is larger than a second threshold.

4. The printing apparatus according to claim 3, wherein the control unit executes the washing process after the moisturizing process.

5. The printing apparatus according to claim 2, wherein the recovery process of the printhead is performed at the time of activation of the printing apparatus.

6. The printing apparatus according to claim 2, wherein the printhead can move between a first position for printing and a second position for the recovery process, printing being performed by discharging liquid from the plurality of orifices, and wherein the control unit performs the recovery process when the printhead is located at the second position.

7. The printing apparatus according to claim 1, further comprising:

a first flow path connected to the first reservoir;

a second flow path connected to the second reservoir;

a common supply path connecting the first flow path to the cap and the second flow path to the cap, wherein the switching unit comprises a three-way valve configured to switch to a state in which the first flow path and the common supply path are connected and switch to a state in which the second flow path and the common supply path are connected.

8. The printing apparatus according to claim 1, further comprising:

a suction unit configured to suck liquid from the cap; and a wiping unit configured to wipe the discharge surface of the printhead.

9. The printing apparatus according to claim 1, further comprising:

a plurality of printheads; and a plurality of caps corresponding to the printheads.

10. A method of controlling a printing apparatus, wherein the printing apparatus includes:

a printhead having a discharge surface on which plurality of orifices for discharging liquid are arranged, a cap configured to cap the discharge surface, a first reservoir configured to hold water, a second reservoir configured to hold a washing liquid used to wash the printhead, and a switching unit configured to switch a reservoir connected to the cap such that one of the first reservoir and the second reservoir is connected to the cap, the method comprising:

selectively supplying one of the water and the washing liquid according to the connected reservoir into the cap without passing through the printhead.

11. The method according to claim 10, wherein one of the water and the washing liquid is supplied to the cap in accordance with recovery process for the printhead.

12. The method according to claim 11, further comprising:

measuring a capping time in which the cap caps the discharge surface; and counting the discharges from the printhead into the cap, wherein a moisturizing process that includes connecting the first reservoir and the cap is executed in a case where the capping time measured is larger than a first threshold, and a washing process that includes connecting the second reservoir and the cap is executed in in a case where the number of discharges counted is larger than a second threshold.

13. The method according to claim 12, wherein the washing process is executed after the moisturizing process.

14. The method according to claim 11, wherein the recovery process of the printhead is performed at the time of activation of the printing apparatus.

15. The method according to claim 11, wherein the printhead can move between a first position for printing and a second position for the recovery process, printing being performed by discharging liquid from the plurality of orifices, and wherein the recovery process is performed when the printhead is located at the second position.

16. The method according to claim 10, further comprising:

sucking liquid from the cap; and wiping the discharge surface of the printhead.

17. The printing apparatus according to claim 1, wherein the washing liquid contains glycerin.

* * * * *